US010916855B1

(12) United States Patent
Rivera et al.

(10) Patent No.: US 10,916,855 B1
(45) Date of Patent: Feb. 9, 2021

(54) CONTOURED-SHAPE ANTENNA WITH WIDE BANDWIDTH

(71) Applicant: The United States of America as represented by the Secretary of the Navy, Newport, RI (US)

(72) Inventors: David F Rivera, Westerly, RI (US); Hailu M Waka, Narragansett, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/562,462

(22) Filed: Sep. 6, 2019

(51) Int. Cl.
*H01Q 9/04* (2006.01)
*H01Q 9/28* (2006.01)
*H01Q 21/20* (2006.01)

(52) U.S. Cl.
CPC ..... *H01Q 9/28* (2013.01); *H01Q 9/045* (2013.01); *H01Q 21/205* (2013.01)

(58) Field of Classification Search
CPC .. H01Q 1/36; H01Q 1/48; H01Q 9/22; H01Q 9/28; H01Q 9/36; H01Q 9/43; H01Q 13/12; H01Q 13/14
See application file for complete search history.

(56) References Cited

U.S. PATENT DOCUMENTS

| | | | | |
|---|---|---|---|---|
| 4,041,499 | A * | 8/1977 | Liu | H01Q 25/04 343/756 |
| 6,642,902 | B2 * | 11/2003 | Gustafson | H01Q 9/22 343/791 |
| 6,867,747 | B2 * | 3/2005 | Price | H01Q 11/08 343/895 |
| 9,941,578 | B2 * | 4/2018 | Gardner | H01Q 1/48 |
| 10,164,340 | B1 * | 12/2018 | Tonn | H01Q 9/27 |
| 2017/0062940 | A1 * | 3/2017 | Cao | H01Q 21/24 |
| 2018/0062251 | A1 * | 3/2018 | Kim | H01Q 13/18 |

* cited by examiner

*Primary Examiner* — Tung X Le
(74) *Attorney, Agent, or Firm* — James M. Kasischke; Michael P. Stanley

(57) ABSTRACT

An antenna is provided as a dipole class radiator with a first bell-shaped element and a second bell-shaped element that extend from a feed gap and are mirror images to each other. Each of the elements has a contour with a combination of curvilinear segments sized to an overall impedance for needed radiation beam pattern properties. In detail, the feed gap with a feed port is between small spherical feed hubs with a larger spherical boss for each element extending away from each feed hub and the feed gap. A frusto-conical section and an adjacent cylindrical section extend from the larger spherical boss for each antenna. The antenna is capable of fitting within a cylindrical shell whose surface area-to-volume ratio is a minimum. The radiation field produced by the antenna is omnidirectional in a horizontal plane. The antenna occupies a minimum surface area-to-volume ratio; thereby, requiring less material.

6 Claims, 10 Drawing Sheets

-PRIOR ART-

-PRIOR ART-

-PRIOR ART-

CONTOURED-SHAPE ANTENNA WITH WIDE BANDWIDTH

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates generally to antennas and more particularly to an antenna for use over wide frequency ranges.

(2) Description of the Prior Art

Antennas that are capable of efficient operation over large bandwidths and without the need for tuning are useful in numerous analog and digital formats for applications such as high definition image transfer and narrow bandwidth reception or transmission. Multiple antenna designs exist that can be adapted for these applications.

However, these antenna designs have at most an 8:1 operational frequency range. Yet, these designs may be satisfactory in many applications. In situations requiring much larger bandwidths, more than one of these antennas, physically scaled to provide an overlap in frequency coverage, are required.

The problem is that the feeding and phasing of each scaled antenna adds undesirable bulk and weight. When compactness is necessary, this bulk and weight becomes unacceptably complex.

In many situations, antenna size is relatively unimportant because an antenna can be in open areas free of obstructions. However, in other circumstances, a wideband antenna may be required to operate in a confined space with the result of a sacrifice in performance.

For example: if an antenna is placed in a cylindrical radome, there must be a shape where the surface area-to-volume ratio is the smallest. Finding this ratio would result in an antenna that is not only physically small but also has a lower cost.

To determine this ratio, consider a prior art cylinder shown in FIG. 1. In the figure, an exterior view of the upright cylinder 1 with a diameter D and a height H is shown. In FIG. 2, the cylinder 1 is disassembled to depict end caps 2 and 3 with a central portion 4 of the cylinder shown in an unfurled and flattened state.

A surface area S of the cylinder 1 is calculated in relation to the diameter D and height H in Equation (1) as $$S = \left(\frac{\pi}{2}\right)D^2 + \pi DH \tag{1}$$

with a volume V provided in Equation (2) as $$V = \left(\frac{\pi}{4}\right)D^2 H \tag{2}$$

Using Equation (1) and Equation (2) for the ratio S/V; Equation (3) yields $$\frac{S}{V} = 2\left(\frac{1}{H} + \frac{2}{D}\right). \tag{3}$$

However, this ratio does not provide details for an optimum ratio D/H such that the ratio S/V is at a minimum. This is because the area (in square units) and the volume (in cubic units) allow the formation of an algebraic expression only in terms of the ratio D/H.

This is turn allows the determination of a minimum surface area-to-volume ratio. To arrive at a desired relationship, a dimensionless relationship must be formed between the pairs of S,V and D,H. This is accomplished by expressing the above ratio S/V in the modified form of Equation (4)

$$\frac{S^3}{V^2} = 2\pi\left(\frac{H}{D}\right)\left[2 + \left(\frac{D}{H}\right)\right]^3 \tag{4}$$

On the left-hand side of Equation (4), $S^3$ and $V^2$ have dimensional units taken to the sixth power, while on the right-hand side of the equation, D and H have dimensional units taken to the first power. The ratios of $S^3/V^2$ and D/H therefore become pure numbers.

Equation (5) is obtained by taking the cube-root of both sides $$\frac{S}{\sqrt[3]{V^2}} = \sqrt[3]{\frac{2\pi H}{D}}\left[2 + \left(\frac{D}{H}\right)\right] \tag{5}$$

The plot of FIG. 3 reflects the results.

As noted in the figure, the region where the quantity $S/\sqrt[3]{V^2}$ is a minimum is fairly broad so that the cylindrical aspect ratio D/H=1 does not need to be strictly adhered to.

SUMMARY OF THE INVENTION

It is therefore a primary object and a general purpose of the present invention to provide an antenna with the widest possible bandwidth to operate in the smallest permissible space with calculable surface area and volume being a factor.

To attain the object of the present invention, a comparatively small antenna is provided in which the size is determined using a voltage standing wave ratio (VSWR) as a performance metric.

The antenna size is determined to be within the minimum surface area-to-volume ratio using Equations (1)-(5). Within this ratio constraint, the shape of the antenna is contoured such that a low input reflection coefficient, as measured at feed terminals of the antenna, is obtained over the widest possible frequency range.

Moreover, because the antenna can operate over numerous octaves with a very low input reflection coefficient; the result is fewer differently sized antennas are required to be combined to obtain larger bandwidths. Fewer differently sized antennas minimize attendant wiring complications and weight.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
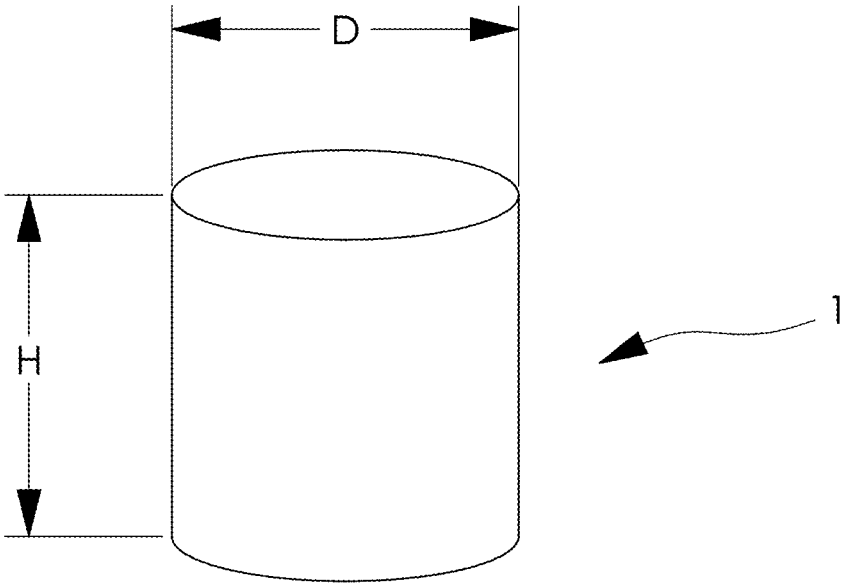
FIG. 1 depicts a prior art cylindrical shell.
Figure 2:
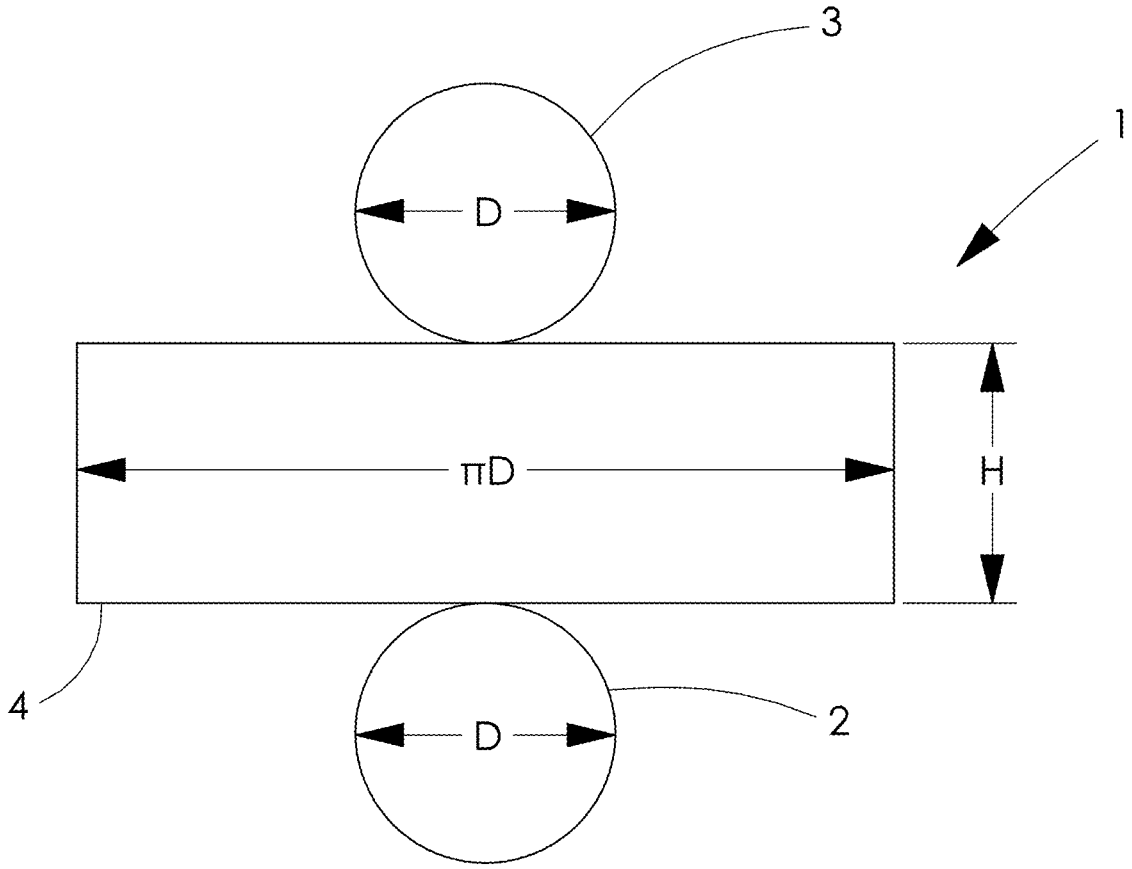
FIG. 2 depicts the prior art cylinder shell disassembled to depict the end caps with the shell shown in an unfurled and flattened state.
Figure 3:
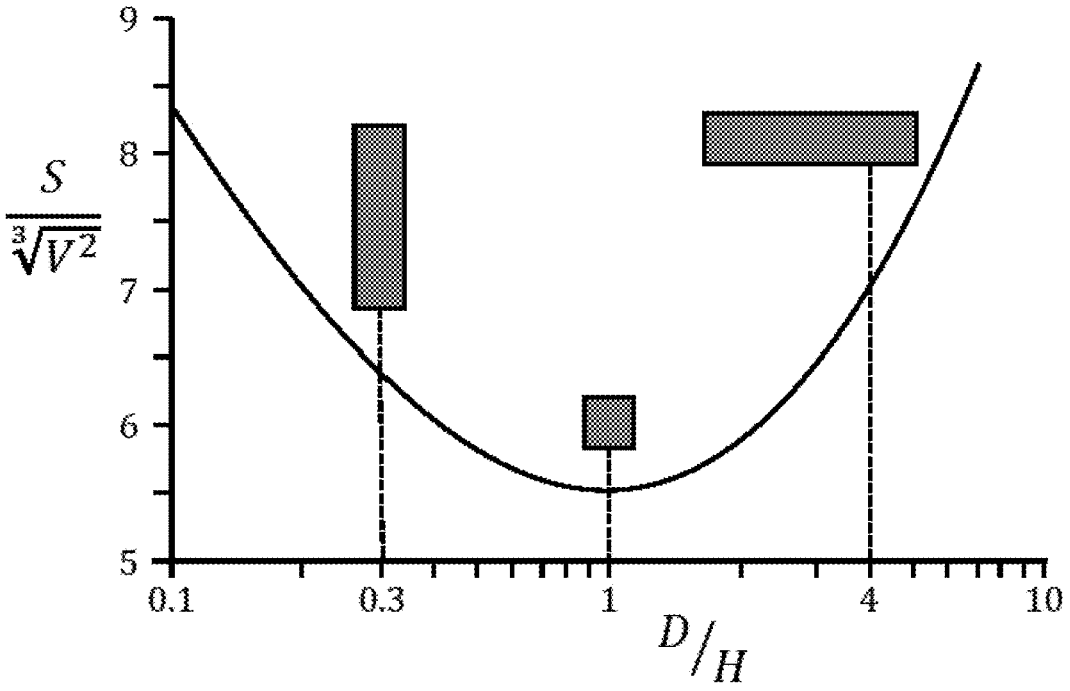
FIG. 3 is a plot of a dimensionless surface area-to-volume ratio of a cylinder versus a diameter-to-height ratio with the plot including comparison cylinder silhouettes.
Figure 4:
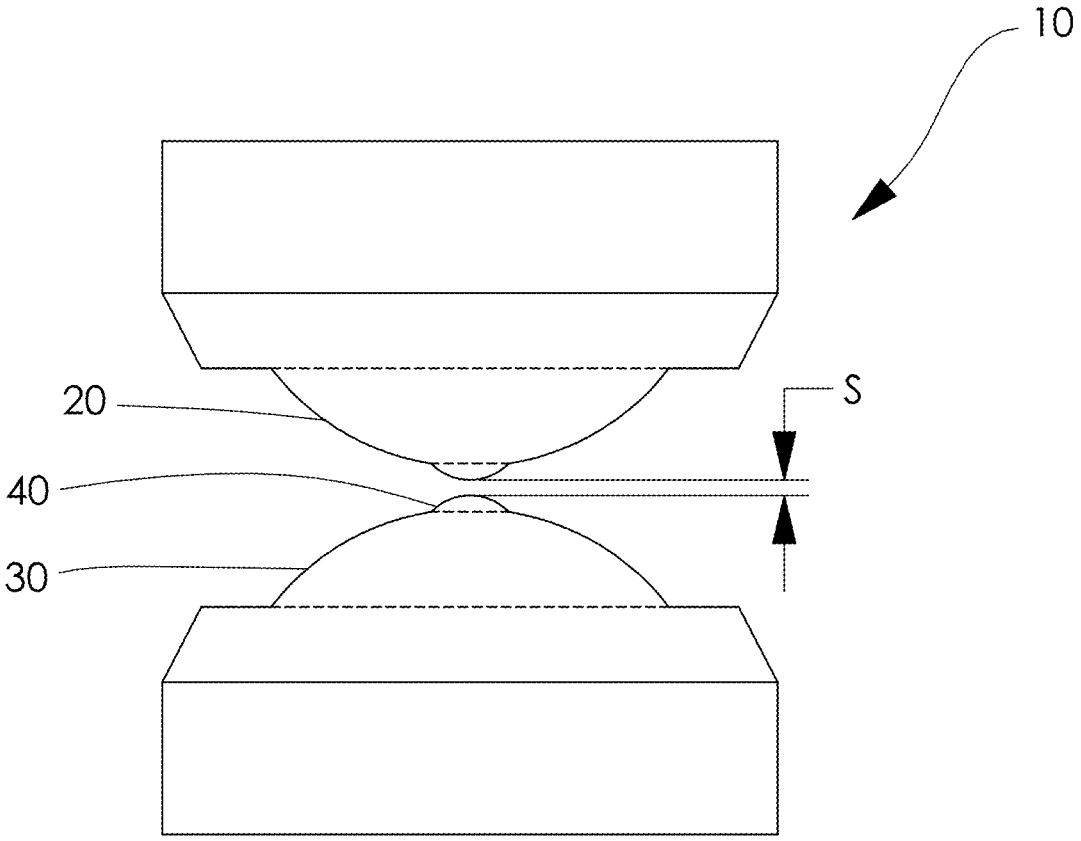
FIG. 4 depicts a wideband contoured dipole antenna of the present invention.

An antenna 10 of the present invention, depicted in FIG. 4, is a dipole class radiator in that the antenna has a first metallic element 20 and a second metallic element 30 that extend from a central feed hub 40. However, unlike a dipole with straight thin-wire or tubular elements, the antenna 10 is comprised of the bell-shaped (or quarter-sphere) first element 20 and the bell-shaped (or quarter-sphere) second element 30, each of which has a contour with a combination of curvilinear segments. The curvilinear segments are sized to a desired overall impedance and for needed radiation beam pattern properties.

Each element is comprised of shapes of differing sizes. For the antenna 10, the size of each shape is determined at a lower half-power (3-dB) frequency. If a frequency f is chosen as the 3-dB frequency; the wavelength A is calculated by Equation (6)

$$\lambda = \frac{v_o}{f} \tag{6}$$

where $v_0$ is the speed of light in air ($\approx 3 \cdot 10^8$ meters/sec).

Having determined this wavelength, one then refers to FIG. 5-8 together with Table I to calculate dimensions of the antenna 10 using the callouts indicated in the figures and the table. Table I provides electrical dimensions at a lower half-power (3-dB) frequency.

A feed gap (symbol S) between arms is depicted in FIG. 4. Fillets employed in an actual antenna are not shown in order to clearly show construction of the antenna 10.

Figure 5:
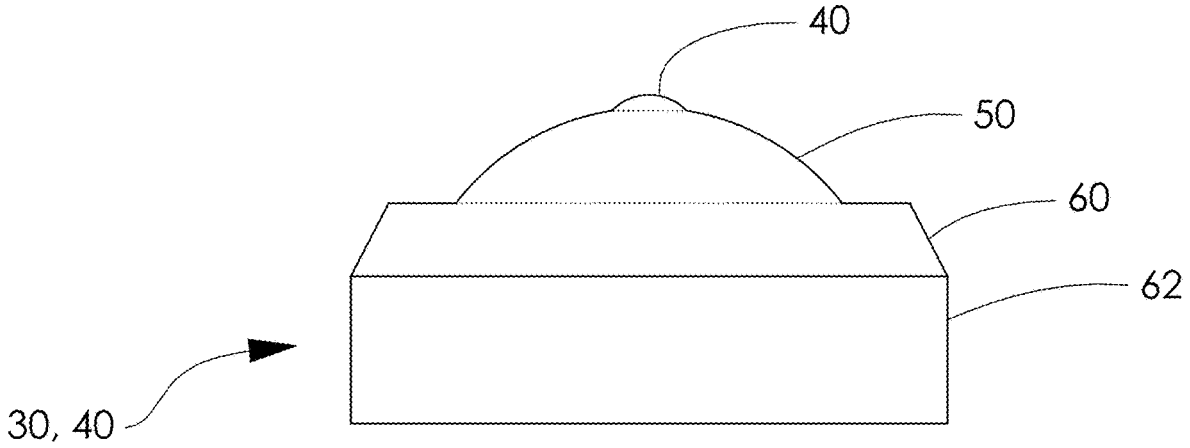
FIG. 5 depicts an arm or element of the antenna of the present invention.
Figure 6:
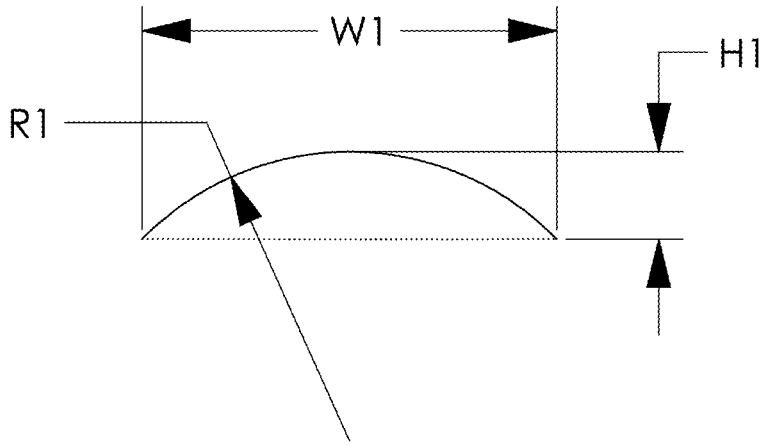
FIG. 6 depicts a central feed hub for a feed region of the antenna.

FIG. 5 depicts an assembled arm or antenna 10 which would represent the first element 20 and the second element 30 as mirror images to each other as depicted in FIG. 4. FIG. 6 represents a central feed hub 40 or a small spherical boss (bell-shaped) in which the boss would be integral to the first element 20 with a second small spherical boss integral to the second element 30. The dimensioning of the elements is provided in Table I.

Figure 7:
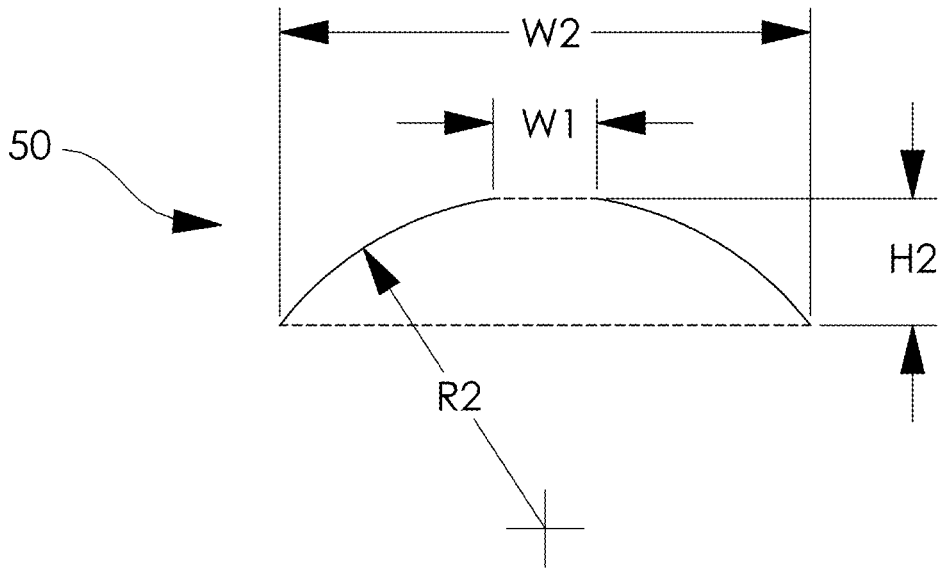
FIG. 7 depicts a spherical boss of the antenna for use proximate to the feed region of the antenna.

FIG. 7 depicts a larger spherical boss 50 in which the bell-shaped boss would be integral to the arm or element of the first element 20 and a second larger spherical boss would be integral to the second element 30 with the dimensioning of the spherical bosses provided in Table I.

Figure 8:
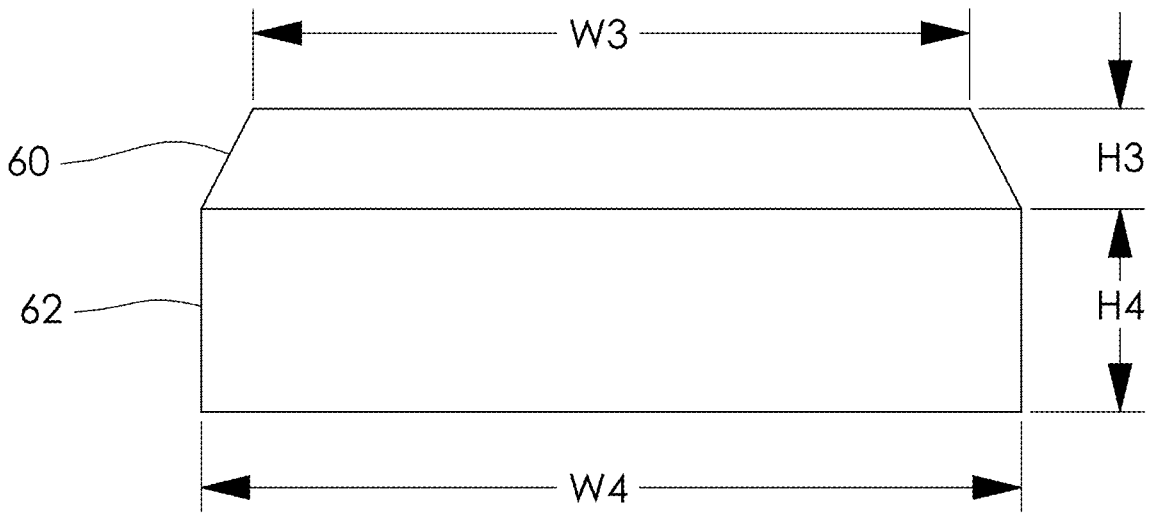
FIG. 8 depicts a frusto-conical section and cylindrical section of the antenna.

FIG. 8 depicts a frusto-conical section 60 and an adjacent cylindrical section 62 of the antenna 10 as part of the first element 20 and the second element 30 as mirror images to each other. The dimensioning of the frusto-conical section 60 and the cylindrical section 62 is provided in Table I.

Figure 9:
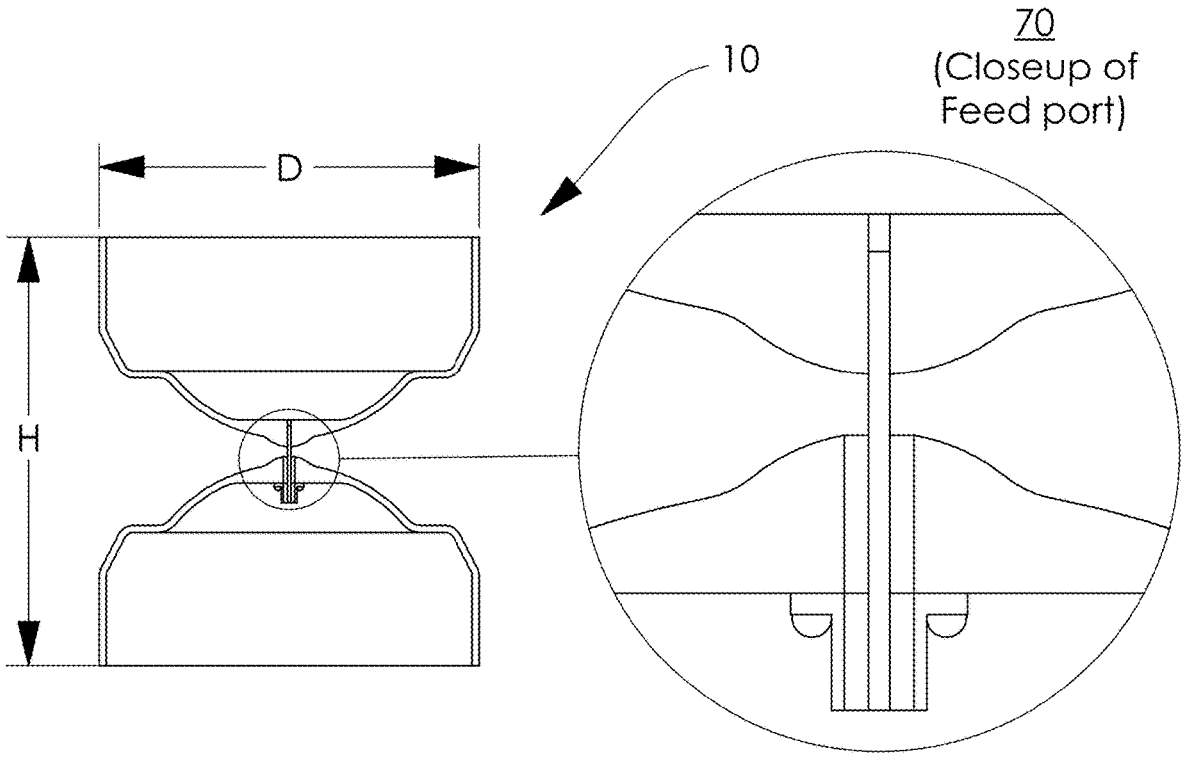
FIG. 9 depicts a cross-sectional view of an assembled antenna of the present invention with a close-up of a feed port for the antenna.

FIG. 9 is a cross-sectional view of the antenna 10 as built with a close-up of a feed port 70. Due to likely packaging restrictions, the antenna 10 has an aspect ratio D/H 0.89 instead of an optimum value. This aspect ratio is within 0.5% of the minimum value of the cylindrical surface area-to-volume ratio, $S/\sqrt[3]{V^2}$.

TABLE I

| Callout | Electrical Dimension |
|---|---|
| H1 | λ/238 |
| H2 | λ/38 |
| H3 | λ/50 |
| H4 | λ/24 |
| R1 | λ/66 |
| R2 | λ/14 |
| W1 | λ/35 |
| W2 | 6λ/55 |
| W3 | λ/7 |
| W4 | λ/6 |
| S | λ/525 |

The antenna 10 is capable of fitting within a cylindrical shell whose surface area-to-volume ratio is a minimum. The antenna 10 may be made from copper or other suitable material.

The radiation field produced by the antenna 10 is omnidirectional in a horizontal plane (i.e., in the plane looking at a diameter of the antenna 10 from above). In an elevation plane (a profile view); the beam pattern is similar in shape to a figure-eight.

A significant realized gain made by the antenna 10 is the ratio of the power radiated by the antenna relative to a fictitious antenna that radiates equally well in all directions (called an isotrope). The term "realized" refers to a power ratio that accounts for ohmic losses and impedance mismatches between the antenna 10 and a (nominal) 50-ohm load.

A second quantity is the reflection co-efficient which is a measure of how well the antenna 10 is matched to the 50-ohm load. Expressed in dB, the reflection co-efficient is a negative number. The more negative, the better that the co-efficient is matched. This figure is also known as the return loss.

From a return loss point-of-view, the contoured antenna 10 behaves as an amalgam of a cylindrical, a bioconical and a hemispherical antenna. As such, from a realized gain point-of-view, the contoured antenna 10 greatly improves return loss characteristics over a wide frequency range.

Figure 10:
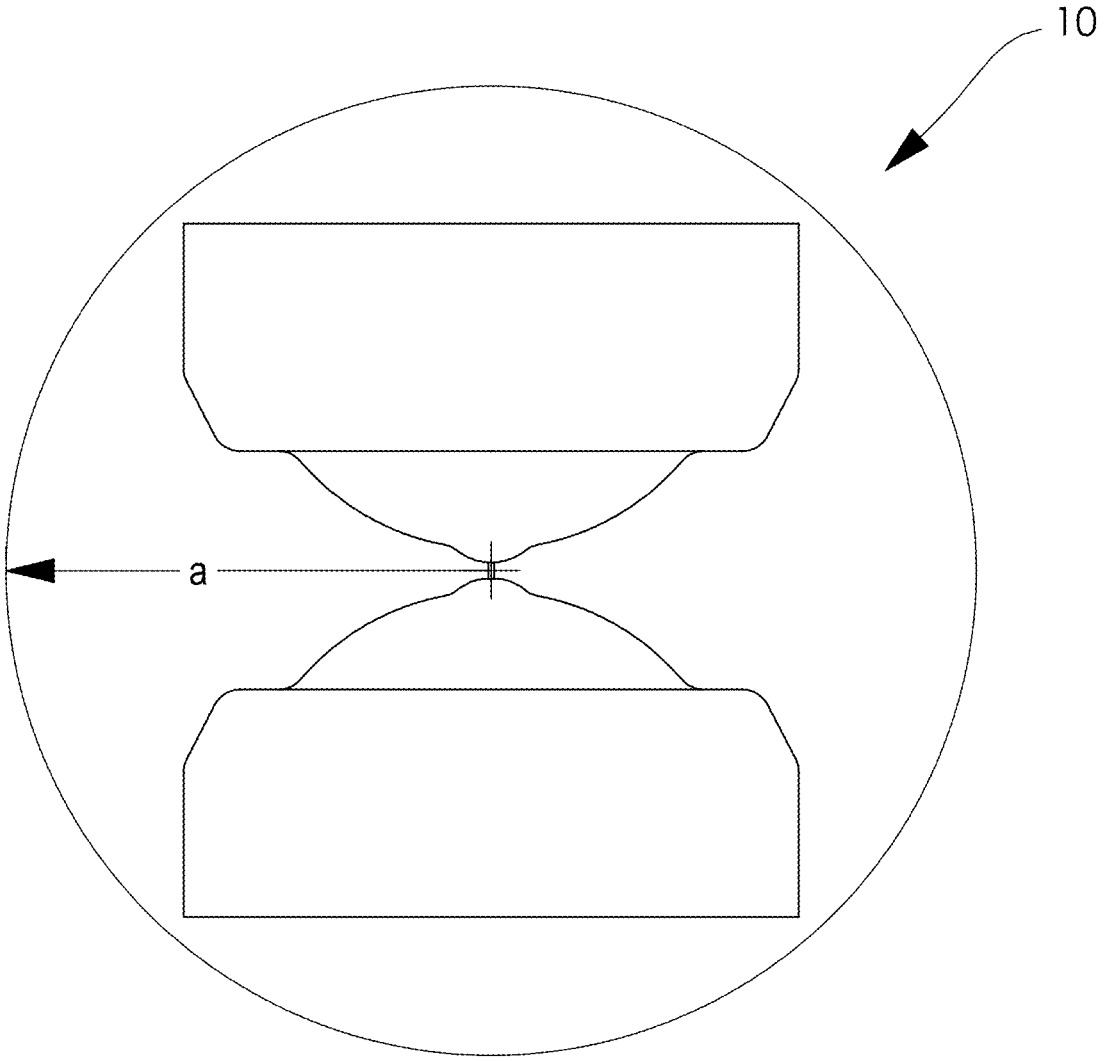
FIG. 10 depicts the antenna surrounded by a non-intersecting sphere.

There are two fundamental characteristics that exist regardless of the shape of the antenna 10. If one were able to envelope each antenna into a hypothetical non-intersecting sphere of radius a, as shown in FIG. 10; general observations can be drawn.

If the wavenumber $k=2\pi/\lambda$ (where $\lambda$ is an arbitrary wavelength); the realized gain has a relatively simple algebraic representation determined to be approximately $$G \approx \frac{1}{\left(\frac{1}{G_o}\right)+\left[\frac{1}{m(ka)}\right]} \tag{7}$$

where in Equation (7); $G_o$ is an average realized gain in the plateau region and m is a constant ($1 \le m \le 2$).

The input (or feed point) reflection coefficient $|\Gamma|$ is expressed in Equation (8) as $$|\Gamma| \approx \frac{1}{1+\left(\frac{1-\rho_o}{\rho_o}\right)(ka)^n} \tag{8}$$

where $\rho_o$ is the reflection coefficient magnitude in the plateau region ($0.3 \le \rho_o \le 0.6$) and n is an exponent.

Both gain and reflection trends indicate that unless $ka>1$; it is difficult to simultaneously obtain good gain and a low reflection coefficient. For $ka>1$, the rates of growth of each quantity are so different that low gain, together with reflection coefficients near unity, are the norm. This trend is also found in other antennas, where a reflection coefficient trend may be similar or differ greatly. As far as the gain trend is concerned, antennas conform to Harrington's limit as calculated in Equation (9)

$$G=(ka)^2+2(ka) \tag{9}$$

An observation for the realized gain indeed shows the same linear trend for values of ka less than unity as does Harrington's formula.

The manipulation of a shape of the antenna 10 to obtain the lowest possible reflection coefficient is essentially an alteration of exponent n and a plateau reflection coefficient, $\rho_0$.

A significant advantage of the antenna 10 of the present invention is that the antenna occupies a minimum cylindrical surface area-to-volume ratio; thereby, requiring less material for fabrication. The antenna 10 has an undulating surface such that there is a very low reflection to a load over a wide frequency range.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. An antenna comprising:

a cylindrical central feed port;

a first metallic element extending away from said central feed port, said first element having an integral quarter-sphere boss as a feed hub with an aperture to encompass and electrically connect to said central feed port at a central curvature of said quarter-sphere boss, a bell-shaped boss with an aperture in alignment with the aperture of said quarter-sphere boss and affixed to said quarter-shaped boss at a curvature of said bell-shaped boss and an electrical connection to said central feed port, a frusto-conical section affixed to said bell-shaped boss at a smaller diameter portion of said section and on a side of said bell-shaped boss opposite to said quarter-shaped boss and a cylindrical section affixed to a larger diameter portion of said frusto-conical section; and a second metallic element at a spaced apart distance and extending away from said central feed port in an opposite direction from said first metallic element, said second element having an integral quarter-sphere boss as a feed hub with an aperture to encompass and electrically connect to said central feed port at a central curvature of said quarter-sphere boss, a bell-shaped boss with an aperture in alignment with the aperture of said quarter-sphere boss and affixed to said quarter-shaped boss at a curvature of said bell-shaped boss with an electrical connection to said central feed port, a frusto-conical section affixed to said bell-shaped boss at a smaller diameter portion of said section and on a side of said bell-shaped boss opposite to said quarter-shaped boss and a cylindrical section affixed to a larger diameter portion of said frusto-conical section.

2. The antenna in accordance with claim 1, wherein the spaced apart distance between said first metallic element and said second metallic element is $\lambda/525$ wherein $\lambda$ is an arbitrary wavelength.

3. The antenna in accordance with claim 2, wherein said integral quarter-sphere boss of said first metallic element has a height of $\lambda/238$ with a diameter of $\lambda/35$ and with a curvature radius of $\lambda/66$; and wherein said integral quarter-sphere boss of said second metallic element has a height of $\lambda/238$ with a diameter of $\lambda/35$ and with a curvature radius of $\lambda/66$.

4. The antenna in accordance with claim 3, wherein said bell-shaped boss of said first metallic element has a height of $\lambda/38$ with a diameter of $6\lambda/55$ and an aperture diameter of $\lambda/35$ and with a curvature radius of $\lambda/14$; and wherein said bell-shaped boss of said second metallic element has a height of $\lambda/38$ with a width of $6\lambda/55$ and an aperture width of $\lambda/35$ and with a curvature radius of $\lambda/14$.

5. The antenna in accordance with claim 4, wherein said frusto-conical section of said first metallic element has a height of $\lambda/50$ with the smaller diameter portion having a diameter of $\lambda/7$; and wherein said frusto-conical section of said second metallic element has a height of $\lambda/50$ with the smaller diameter portion having a diameter of $\lambda/7$.

6. The antenna in accordance with claim 5, wherein said cylindrical section of said first metallic element has a height of $\lambda/24$ with a diameter of $\lambda/6$; and wherein said cylindrical section of said second metallic element has a height of $\lambda/24$ with a diameter of $\lambda/6$.

* * * * *